US007618262B2

(12) United States Patent
Fogg et al.

(10) Patent No.: US 7,618,262 B2
(45) Date of Patent: Nov. 17, 2009

(54) MODULAR ELECTRICAL CONNECTOR WITH ENHANCED JACK INTERFACE

(75) Inventors: Michael Warren Fogg, Harrisburg, PA (US); John Francis D'Ambrosia, Harrisburg, PA (US); Randall Robert Henry, Harrisburg, PA (US); Michael John Phillips, Camp Hill, PA (US); Robert Charles Trea, Harrisburg, PA (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 11/869,566

(22) Filed: Oct. 9, 2007

(65) Prior Publication Data

US 2009/0093140 A1 Apr. 9, 2009

(51) Int. Cl.
*H01R 12/00* (2006.01)

(52) U.S. Cl. ..... 439/65; 439/638; 439/11; 439/218

(58) Field of Classification Search ..... 439/65, 439/638, 11, 218, 640
See application file for complete search history.

(56) References Cited

U.S. PATENT DOCUMENTS

| | | | | |
|---|---|---|---|---|
| 5,425,172 | A * | 6/1995 | Carswell et al. | 29/884 |
| 5,462,457 | A | 10/1995 | Schroepfer | |
| 5,651,690 | A * | 7/1997 | Klas et al. | 439/352 |
| 5,947,761 | A | 9/1999 | Pepe | |
| 6,062,908 | A | 5/2000 | Jones | |
| 6,120,329 | A | 9/2000 | Steinman | |
| 6,319,069 | B1 | 11/2001 | Gwiazdowski | |
| 6,655,988 | B1 | 12/2003 | Simmons et al. | |
| 6,695,622 | B2 * | 2/2004 | Korsunsky et al. | 439/65 |
| 6,796,844 | B1 * | 9/2004 | Edwards, III | 439/638 |
| 7,025,636 | B2 * | 4/2006 | Allen | 439/638 |
| 7,048,550 | B2 | 5/2006 | Hyland et al. | |
| 7,195,518 | B2 | 3/2007 | Bert et al. | |
| 7,207,807 | B2 | 4/2007 | Fogg | |
| 7,255,567 | B1 * | 8/2007 | Liao | 439/11 |
| 2005/0037655 | A1 | 2/2005 | Henry et al. | |
| 2005/0282432 | A1 | 12/2005 | Murr et al. | |
| 2007/0232146 | A1 | 10/2007 | Yamakami | |

FOREIGN PATENT DOCUMENTS

WO WO 2006/000238 A1 1/2006

OTHER PUBLICATIONS

European Search Report dated Feb. 13, 2009 in European Application No. EP 08 16 6218.

* cited by examiner

*Primary Examiner*—Truc T Nguyen

(57) ABSTRACT

An electrical connector includes a contact sub-assembly having a plurality of contacts arranged on a contact support member. The contact support member has a pair of opposed support walls extending from a base to a mating end, and the support walls are separated by a gap that extends from the mating end toward the base. The contacts extend at least partially along the support walls between the mating end and the base, wherein a first set of the contacts are provided on one of the support walls and a second set of the contacts are provided on the other of the support walls. The contacts are exposed to the gap for connection with a mating connector received within the gap. The electrical connector also includes a housing having a cavity configured to receive the mating connector, wherein the contact sub-assembly is received within the cavity for mating with the mating connector.

20 Claims, 8 Drawing Sheets

MODULAR ELECTRICAL CONNECTOR WITH ENHANCED JACK INTERFACE

BACKGROUND OF THE INVENTION

The subject matter herein relates generally to electrical connectors, and more particularly, to electrical connectors having an enhanced jack interface.

In electrical systems, there is increasing concern for preserving signal integrity as signal speed and bandwidth increase. One source of signal degradation is crosstalk between multiple signal paths. In the case of an electrical connector carrying multiple signals, crosstalk occurs when signals conducted over a first signal path are partly transferred by inductive or capacitive coupling into a second signal path. The transferred signals produce crosstalk in the second path that degrades the signal routed over the second path.

For example, a typical industry standard type RJ-45 communication connector includes four pairs of contacts defining different signal paths. The RJ-45 plug and jack designs are dictated by industry standards and are inherently susceptible to crosstalk. In conventional RJ-45 plug and jack connectors, all four pairs of contacts extend closely parallel to one another over a length of the connector body. One pair of contacts is also split around another contact pair. Thus, signal crosstalk may be induced between and among different pairs of connector conductors. The amplitude of the crosstalk, or the degree of signal degradation, generally increases as the frequency increases.

At least some RJ-45 jacks include features that are intended to suppress or compensate for crosstalk. The shortcomings that are inherent in jacks such as the RJ-45 can be expected to become more serious as system demands continue to increase. It would be desirable to develop a connector that is designed to minimize internal crosstalk at the outset rather than to correct for crosstalk after the fact.

BRIEF DESCRIPTION OF THE INVENTION

In one embodiment, an electrical connector is provided that includes a contact sub-assembly having a plurality of contacts arranged on a contact support member. The contact support member has a pair of opposed support walls extending from a base to a mating end, and the support walls are separated by a gap that extends from the mating end toward the base. The contacts extend at least partially along the support walls between the mating end and the base, wherein a first set of the contacts are provided on one of the support walls and a second set of the contacts are provided on the other of the support walls. The contacts are exposed to the gap for connection with a mating connector received within the gap. The electrical connector also includes a housing having a cavity configured to receive the mating connector, wherein the contact sub-assembly is received within the cavity for mating with the mating connector.

Optionally, the cavity may concentrically surround the support walls from the bases to the mating ends. The electrical connector may be configured to be co-nested with the mating connector, wherein the housing surrounds a perimeter of the mating connector and the mating connector surrounds a perimeter of the contact support member along a mating axis. The cable support member may completely enclose the gap. Optionally, the housing may be configured to receive the mating connector within the cavity such that the mating connector surrounds a perimeter of the contact support member at least along a portion of a length of the support walls from the bases to the mating ends. Optionally, the housing may have inner walls defining the cavity, each support wall being spaced apart from the inner walls of the housing.

In another embodiment, an electrical connector is provided including a housing and a plurality of contact sub-assemblies coupled to the housing. The housing includes a mating end and a terminating end, and the housing has a plurality of cavities that receive respective ones of the contact sub-assemblies therein. The cavities are configured to receive mating connectors through the mating end of the housing for interconnection with the contact sub-assemblies. Each contact sub-assembly includes a base, a contact support member and a plurality of contacts. The base is coupled to the terminating end of the housing and is configured for mounting to a mating component, and the contact support member extends from the base and has a pair of opposed, axially extending, support walls that are separated by a gap. Each support wall includes an inner surface facing the gap, and the contacts are arranged on the inner surfaces of respective ones of the support walls.

In a further embodiment, an electrical connector is provided including a housing having a first mating end and a second mating end. The first mating end having a cavity configured to receive a first mating connector, and the second mating end having mating contacts for engaging a second mating connector. The electrical connector also includes a contact sub-assembly at least partially received within the cavity for mating with the first mating connector. The contact sub-assembly includes a base, a contact support member and a plurality of contacts, wherein the contact support member extends from the base and is at least partially received within the cavity. The contact support member has a pair of opposed, axially extending, support walls that are separated by a gap, and each support wall includes an inner surface facing the gap. The contacts are arranged on the inner surfaces of respective ones of the support walls for engagement with the first mating connector, and the contacts are terminated to the base and electrically connected to the mating contacts at the second mating end of the housing by the base.

DETAILED DESCRIPTION OF THE INVENTION

Figure 1:
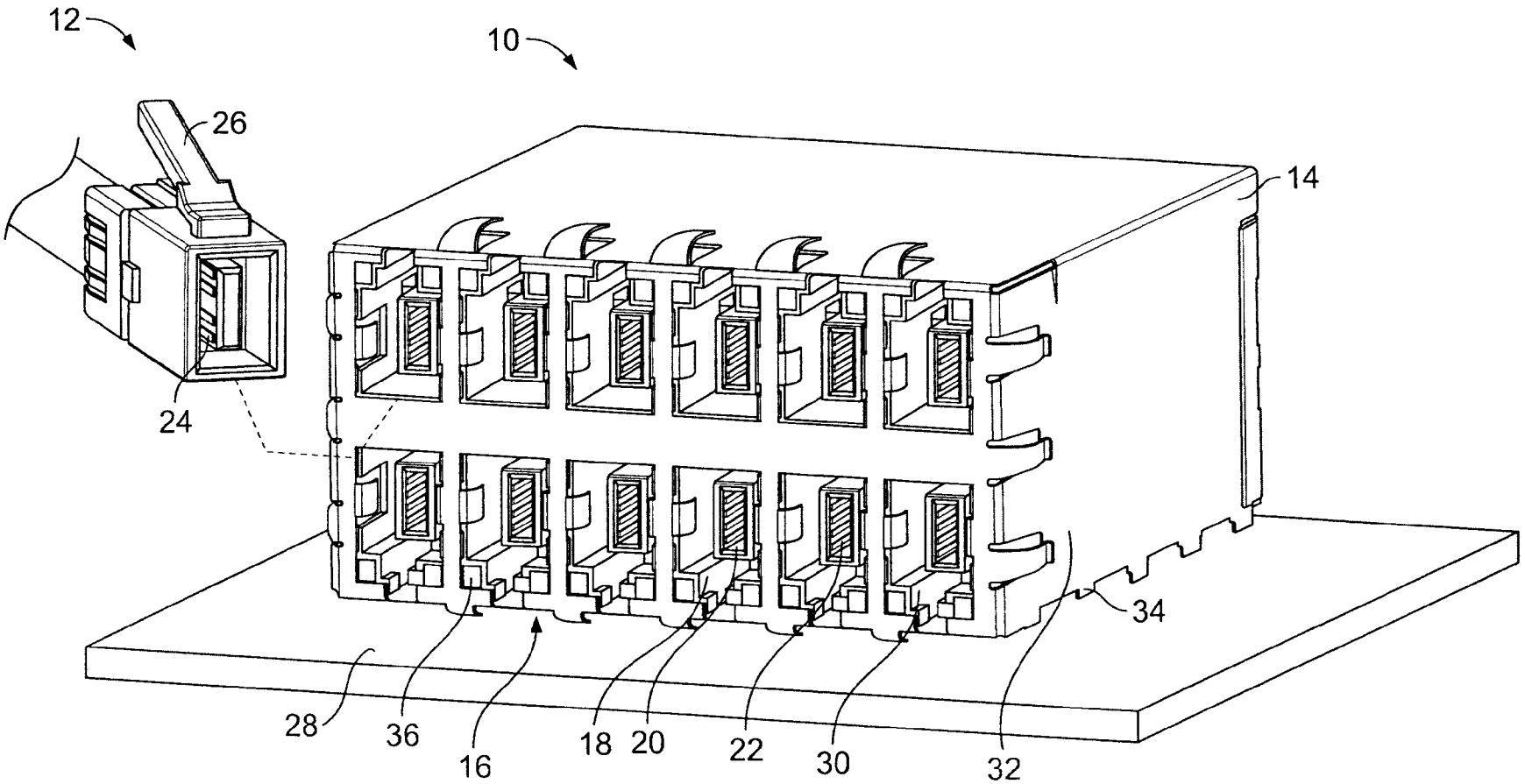
FIG. 1 is a perspective view of an exemplary electrical connector formed in accordance with an exemplary embodiment.

FIG. 1 is a perspective view of an exemplary electrical connector 10 formed in accordance with an exemplary embodiment. The electrical connector 10 represents a receptacle connector that receives a mating connector 12, represented by the plug connector in FIG. 1. The electrical connector 10 and the mating connector 12 are modular connectors, such as the types of electrical connectors used for connecting telecommunications equipment or computer networking equipment. In the illustrated embodiment, the electrical connector 10 and the mating connector 12 are eight pin, eight conductor (8P8C) modular connectors having signal pairs, however the subject matter described herein also has applicability to other connectors having fewer or greater numbers of pins, conductors and/or signal pairs.

In an exemplary embodiment, the electrical connector 10 includes a housing 14 having multiple communication ports 16 opening to cavities 18 that receive respective ones of the mating connectors 12. The electrical connector 10 also includes contact sub-assemblies 20 that are arranged within respective ones of the cavities 18 for mating with the mating connector 12. Each of the contact sub-assemblies 20 includes a plurality of contacts 22 arranged along a mating interface for mating with mating contacts 24 of the mating connector 12. For example, the contacts 22 and the mating contacts 24 are arranged in similar patterns for mating engagement. Optionally, the contacts 22 and mating contacts 24 are arranged, or grouped, as differential signal pairs. In an exemplary embodiment, the mating connector 12 includes a latch 26 on an exterior surface thereof for securing the mating connector 12 within the cavity 18.

The housing 14 is mounted to a substrate 28. Optionally, the substrate 28 may represent a circuit board and the electrical connector may be mechanically and electrically connected to the circuit board for sending and receiving signals. Optionally, a plurality of electrical connectors 10 may be mounted to the substrate 28. The substrate 28 and electrical connector(s) 10 may be mounted within an electrical device or apparatus having a communications port through which the device may communicate with other externally networked devices. Alternatively, the electrical connector 10 may be wall mounted or panel mounted for connection with the mating connectors 12. In some embodiments, the electrical connector 10 may include only a single cavity 18 and corresponding contact sub-assembly 20 for mating with a single mating connector 12. Additionally, in some embodiments, rather than sending and receiving the signals via a circuit board, the electrical connector 10, or more particularly, the contact sub-assemblies 20, may be terminated to an end of a cable (not shown).

In an exemplary embodiment, the housing 14 includes a dielectric body 30 that defines the cavities 18. A cover 32 at least partially surrounds the body 30 and the contact sub-assemblies 20. Optionally, the cover 32 may be metallic and may define a shield, such as an electromagnetic interference (EMI) shield. The cover 32 includes mounting tabs 34 for mounting to the substrate 28. For example, the mounting tabs 34 may be eye-of-the-needle pins that are pressed into the substrate 28 for mechanically and electrically connecting the cover 32 to the substrate 28. In an exemplary embodiment, the electrical connector 10 may include light emitting diodes (LED's) 36, or other types of indicators, associated with respective ones of the cavities 18 for identifying a connectivity or operational state of the contact sub-assembly 20 associated therewith.

Figure 2:
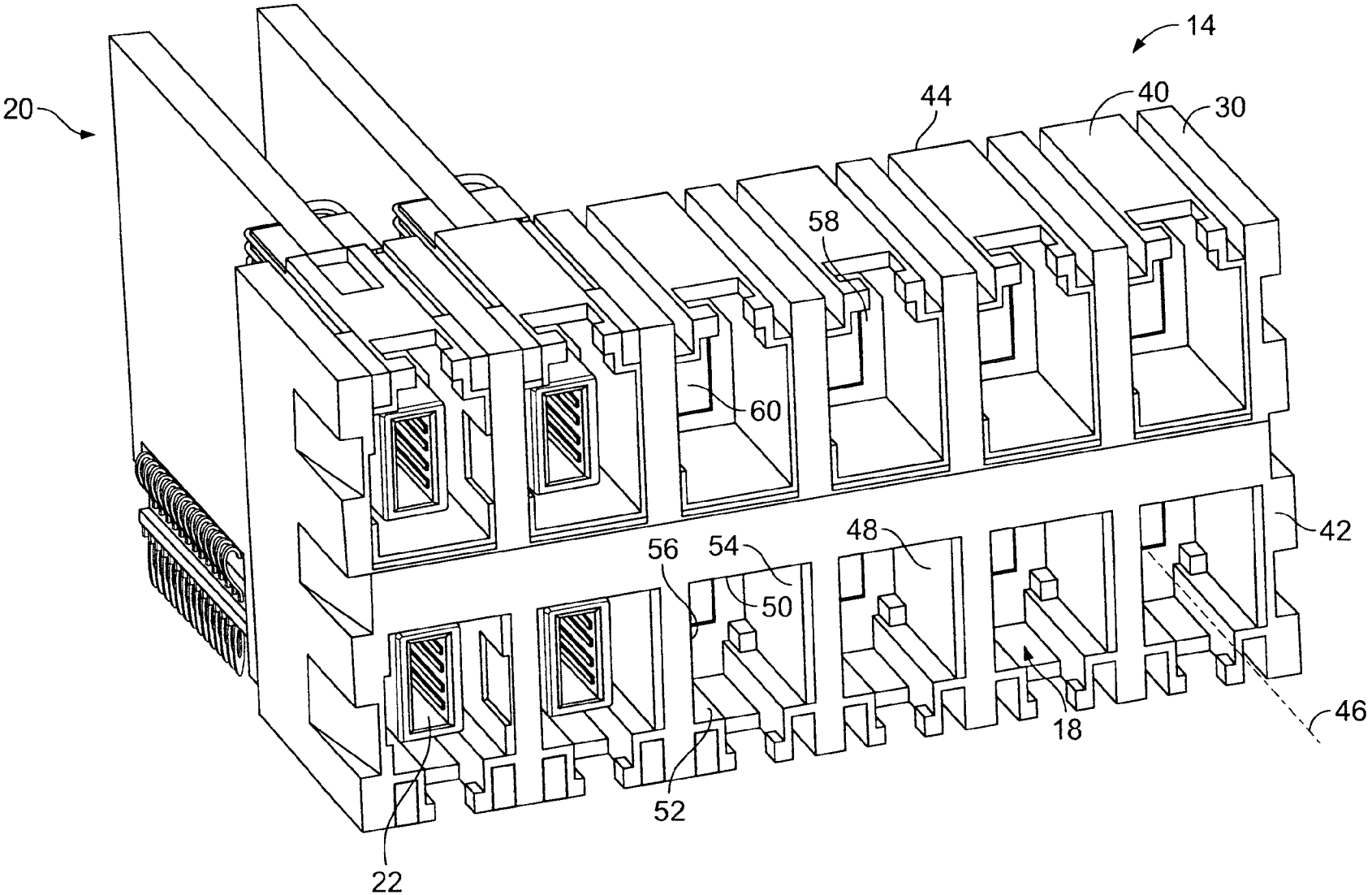
FIG. 2 is a front perspective view of a housing and a plurality of contact sub-assemblies for the electrical connector shown in FIG. 1.

FIG. 2 is a front perspective view of the housing 14 with the cover 32 (shown in FIG. 1) removed and a plurality of the contact sub-assemblies 20 coupled to the housing 14. The housing body 30 includes outer walls 40 that define a perimeter of the housing body 30. The outer walls 40 extend between a mating end 42 and a terminating end 44 of the housing body 30. The cavities 18 are open at the mating end 42 for receiving the mating connectors 12 (shown in FIG. 1), and each extend along a cavity axis 46 at least partially between the mating end 42 and the terminating end 44. Optionally, the mating connector 12 may be loaded into the cavity 18 in a direction substantially parallel to the cavity axis 46. In the illustrated embodiment, the cavities 18 are arranged in two rows and six columns, however, fewer or greater rows and/or columns of cavities 18 may be provided in alternative embodiments.

The cavities 18 are defined by inner walls 48 of the housing body 30. In the illustrated embodiment, the inner walls 48 define a cavity 18 having a rectangular cross-section with an upper wall 50, a lower wall 52, and opposed side walls 54, 56. However, the cavities 18 may have alternative shapes, including non-planar wall surfaces, in alternative embodiments. The inner walls 48 also define a bottom wall 58 along the terminating end 44. An opening 60 extends through the bottom wall 58, and a portion of the contact sub-assembly 20 extends through the opening 60 into the cavity 18.

The contact sub-assemblies 20 generally include the contacts 22 and a sub-structure for supporting or holding the contacts for mating engagement with the mating connector 12 as well as for terminating, or otherwise interconnecting, the contacts with a mating component, such as the substrate 28 (shown in FIG. 1) or individual wires of a cable (not shown). Exemplary contact sub-assemblies 20 are illustrated in FIG. 2, and are described in further detail in FIG. 3.

Figure 3:
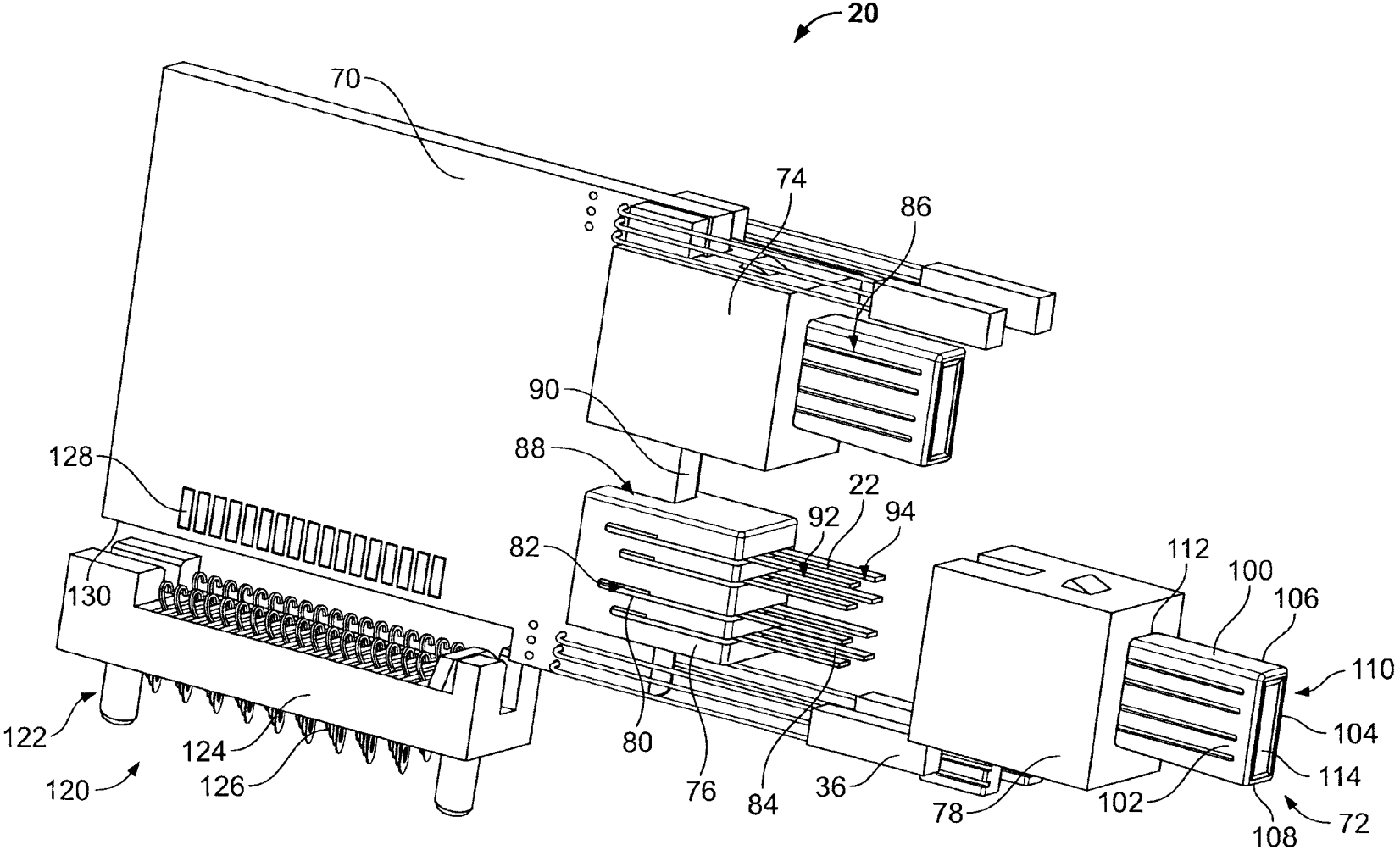
FIG. 3 is an exploded view of the exemplary contact sub-assembly shown in FIG. 2.

FIG. 3 is an exploded view of an exemplary one of the contact sub-assemblies 20. The contact sub-assembly 20 includes a base 70, a first contact support member 72 and a second contact support member 74. In an exemplary embodiment, the base 70 is a circuit board, and the contacts 22 are terminated to the circuit board. However, in alternative embodiments, such as an embodiment wherein the contact sub-assembly is terminated directly to a cable, the base 70 may be a different component, such as a housing component that is used to mount to the end of the cable. For example, the base 70 may be formed as part of, or may be used in conjunction with, the housing body 30 (shown in FIG. 2) and may be mounted to the end of the cable.

Both contact support members 72, 74 are coupled to the base 70 and are arranged in a stacked configuration. Each contact support member 72, 74 supports a set of contacts 22 that is used for interfacing with a different mating connector 12 (shown in FIG. 1). Additionally, each contact support member 72, 74 and corresponding set of contacts 22 are received within a different cavity 18 (shown in FIGS. 1 and 2) for interfacing with the corresponding mating connector 12. While two contact support members 72, 74 are illustrated in the embodiment shown in FIG. 3, it is realized that more or less than two contact support members may be provided in alternative embodiments. For example, the number of contact support members may depend on the number of cavities 18 arranged in one of the columns of cavities of the housing 14 (shown in FIG. 2). Similarly, the housing 14 may only include a single row of cavities 18, or possibly only a single cavity 18, in which case, the contact sub-assembly 20 may only include a single contact support member and corresponding set of contacts 22.

In an exemplary embodiment, each contact support member 72, 74 may include an inner support member 76 and an outer support member 78. The inner support member 76 is coupled to the base 70 and supports a first portion of the contacts 22, such as a portion of the contacts 22 proximate a terminating end 80 of the contacts 22. Optionally, the contacts 22 may be received within slots 82 extending along the inner support member 76. The outer support member 78 is coupled to the base 70 and/or the inner support member 76 and supports a second portion of the contacts 22, such as a portion of the contacts 22 proximate a mating end 84 of the contacts 22. Optionally, the contacts 22 may be received within slots 86 extending along the outer support member 78. In the illustrated embodiment, a portion of the outer support member 78 covers and encloses the inner support member 76, however the outer support member 78 may be coupled to an end of the inner support member 76 in an alternative embodiment, such that at least a portion of the inner support member 76 is not covered. In other alternative embodiments, the inner and outer support members 76, 78 may be a single element as opposed. to separate members.

In an exemplary embodiment, the inner or outer support member 76, 78 cooperate to support an entire length of the contacts 22 (e.g. measured from the mating end 84 to the terminating end 80). Alternatively, portions of the contacts 22 may remain unsupported, such as an interior portion or an end portion of the contacts 22. The mating ends 84 of the contacts 22 are positioned by the contact support members 72, 74 to mate with the mating connector 12 (shown in FIG. 1). The terminating ends 80 of the contacts 22 are positioned by the contact support members 72, 74 to mate with the base 70. For example, the inner support member 76 includes a base slot 88 that receives an edge 90 of the base 70. The contacts 22 are exposed along the base slot 88 such that the contacts 22 engage pads (not shown) on the edge of the base 70. Alternatively, the contacts 22 may be mounted within through holes or vias at the edge 90 of the base 70 and mechanically and electrically connected thereto by soldering or compliant pin connections. In such embodiments, the inner support member 76 is mounted to the base 70 after the contacts 22 are coupled to the base 70 such that the contacts 22 are received within the slots 82.

As described above, the contacts 22 are arranged as differential pairs of contacts in an exemplary embodiment. The contacts 22 forming each differential pair are closely spaced with respect to one another to provide adequate inductive coupling between the contacts 22. In an exemplary embodiment, the contacts 22 extend substantially straight through the contact support member 72, 74 from the mating end 84 to the terminating end 80. Optionally, the contacts 22 may be more closely positioned with respect to the corresponding contact of the differential pair than any of the other contacts within the contact set. The contacts 22 are arranged as a first set of contacts 92 having a first differential pair and a second differential pair and a second set of contacts 94 having a third differential pair and a fourth differential pair. The contacts 22 within the first set of contacts 92 are all substantially coplanar with one another along their lengths and the contacts 22 within the second set of contacts 94 are all substantially coplanar with one another along their lengths.

Each of the contact support members 72, 74 includes a mating portion 100. The mating portion 100 is received within the cavity 18 (shown in FIG. 1) and interfaces with the mating component 12 (shown in FIG. 1). The mating portion 100 includes opposed support walls 102, 104 and end walls 106, 108 extending between the support walls 102, 104. The mating portion 100 defines a gap 110 between the support walls 102, 104 and between the end walls 106, 108. The gap 110 defines a space sized and shaped to accept a portion of the mating connector 12 therein. Additionally, the contacts 22 extend along the support walls 102, 104 such that the contacts 22 face, and are exposed to, the gap 110. In an exemplary embodiment, the first set of contacts 92 extend along the support wall 102 and the second set of contacts extend along the other support wall 104. The contacts 22 mate with the mating contacts 24 (shown in FIG. 1) within the gap 110. The support walls 102, 104 extend from a base end 112 to a mating end 114 which is further from the base 70 than then base end 112.

The contact sub-assembly 20 includes a mounting interface 120 that is mounted to a mounting component, such as the substrate 28 (shown in FIG. 1). The mounting component may be a cable or other component or device in alternative embodiments. In an exemplary embodiment, a header assembly 122 is provided at the mounting interface 120. The header assembly 122 includes a header body 124 having a plurality of mounting contacts 126 therein. The header body 124 and the mounting contacts 126 are mounted to the substrate 28. The header body 124 is coupled to the base 70 such that the mounted contacts are mechanically and electrically connected to pads 128 along an edge 130 of the base 70. Optionally, the edge 130 may be substantially perpendicular to the edge 90. Alternatively, the edge 130 may have a non-perpendicular orientation with respect to the edge 90, such as a parallel and opposed orientation. The contacts 22 are electrically connected to the mounting contacts 126 by the base 70, such as by traces along the base 70.

In an exemplary embodiment, the LED's 36 are electrically connected to the base 70. The LED's 36 may be electrically connected to the mounting contacts 126 by the base 70. The contact support members 72, 74 may support respective ones of the LED's 36.

Figure 4:
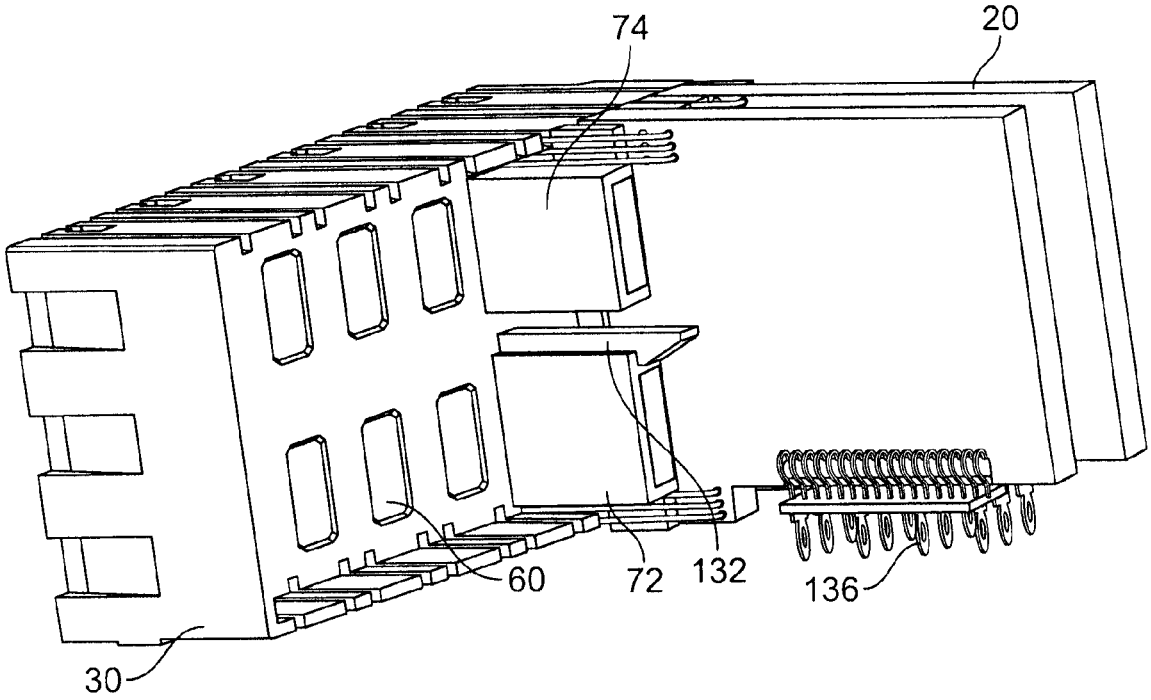
FIG. 4 is a rear perspective view of the housing and the contact sub-assemblies shown in FIG. 2.

FIG. 4 is a rear perspective view of the housing body 30 and the contact sub-assemblies 20. The contact sub-assemblies 20 are mounted to the housing body 30. A latch 132 is used to secure the contact sub-assembly 20 to the housing body 30. Alternatively, the contact sub-assemblies 20 may be attached to the housing body 30 using an alternative securing method or means, such as an interference fit or other securing device. When assembled, the mounting portions 100 (shown in FIG. 3) of the first and second contact support members 72, 74 are received within respective ones of the openings 60. Once assembled, the housing body 30 and the contact sub-assemblies 20 may be mounted to the substrate 28 (shown in FIG. 1) as a unit. The mounting contacts 136 may be aligned with respective holes (not shown) in the substrate 28 and mounted thereto.

Figure 5:
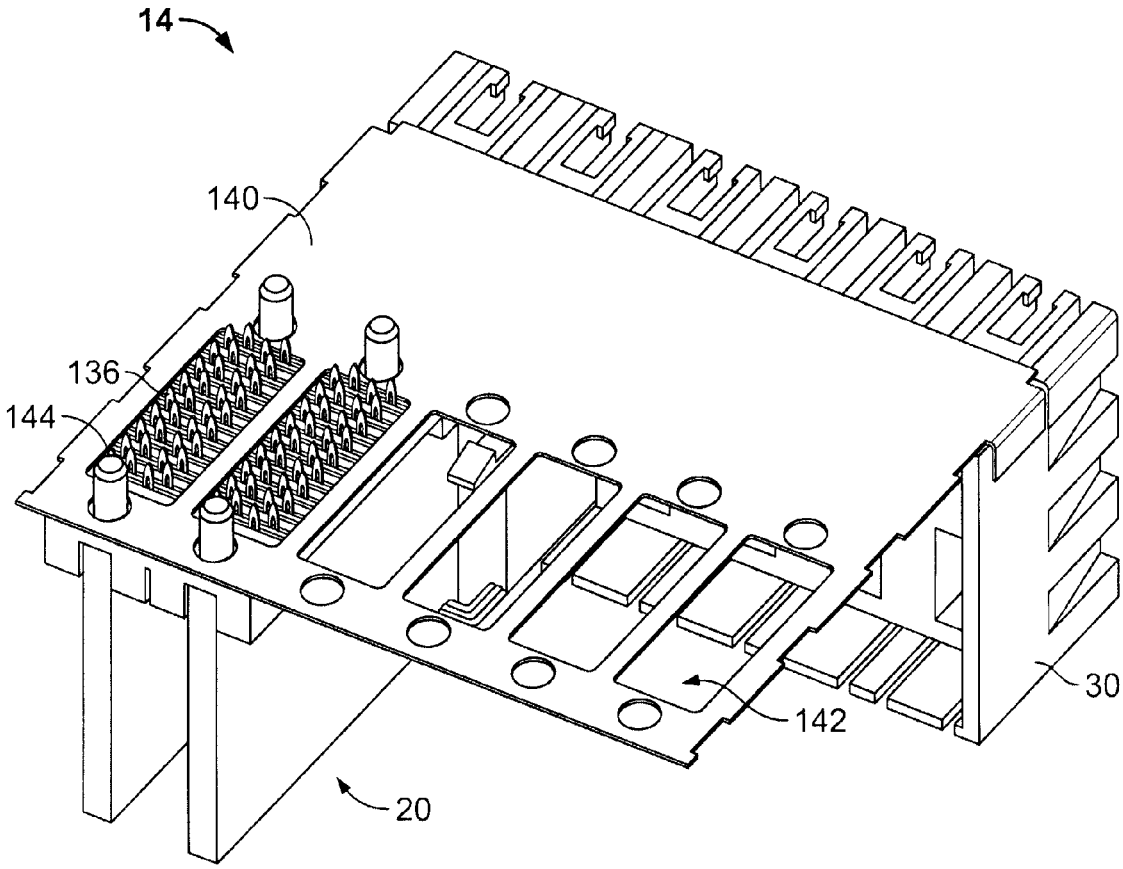
FIG. 5 is a bottom perspective view of the housing and the contact sub-assemblies shown in FIG. 2.

FIG. 5 is a bottom perspective view of the housing body 30 and the contact sub-assemblies 20. A bottom plate 140 forms part of the housing 14 (shown in FIG. 1) and is secured to the cover 32. The bottom plate 140 cooperates with the cover 32 (shown in FIG. 1) to surround the housing body 30 and the contact sub-assemblies 20. The bottom plate 140 provides shielding, such as EMI shielding. Openings 142 are provided in the bottom plate that receive the mounting contacts 136 and mounting lugs 144 of the header assembly 122 for mounting to the substrate 28.

Figure 6:
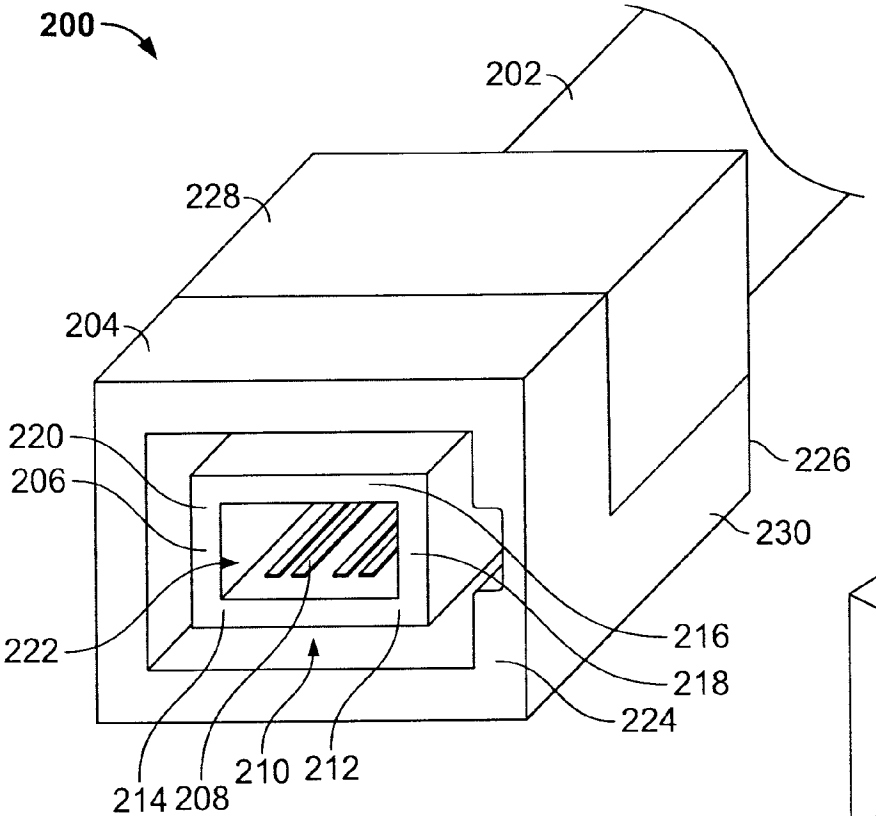
FIG. 6 is a front perspective view of another electrical connector formed in accordance with an alternative embodiment and attached to a cable.

FIG. 6 is a front perspective view of another electrical connector 200 formed in accordance with an alternative embodiment and attached to a cable 202. The electrical connector 200 includes a housing 204 and a contact sub-assembly 206 having a plurality of contacts 208 for mating with a mating connector (not shown). The electrical connector 200 represents a receptacle connector having a cavity 210 that receives the mating connector. The electrical connector 200 is configured for mating with a plug-type mating connector having a mating interface configured for mating engagement with the electrical connector 200. For example, the mating connector is received within the cavity 210 and includes mating contacts that engage the contacts 208.

The contact sub-assembly 206 includes a mating portion 212 having opposed support walls 214, 216 and end walls 218, 220 extending between the support walls 214, 216. The mating portion 212 defines a gap 222 between the support walls 214, 216 and between the end walls 218, 220. The gap 222 defines a space sized and shaped to accept a portion of the mating connector therein. Additionally, the contacts 208 extend along the support walls 214, 216 such that the contacts 208 face, and are exposed to, the gap 222.

The housing 204 extends between a mating end 224 and a terminating end 226. The cable 202 is secured to the terminating end 226 of the housing 204. Optionally, the housing 204 may include a cap portion 228 that is removably coupled to a main housing portion 230.

Figure 7:
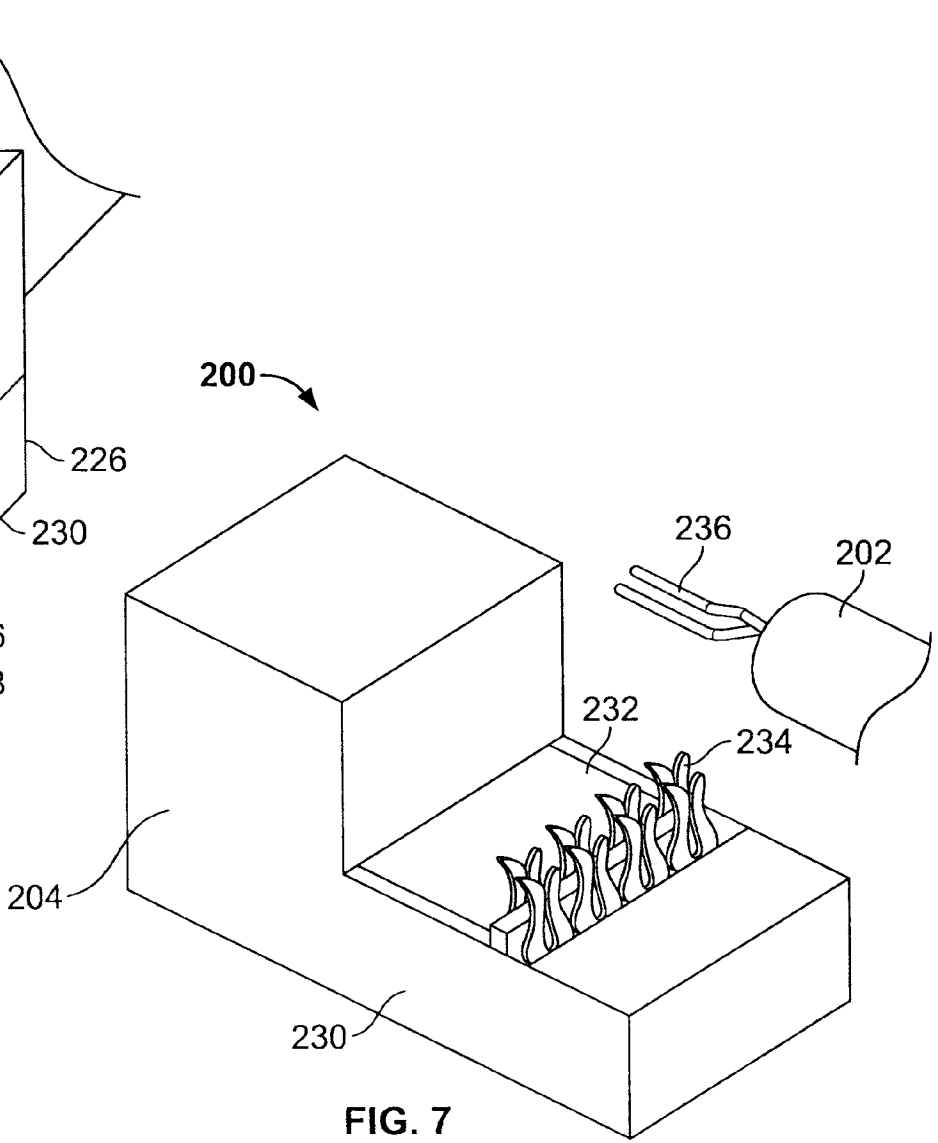
FIG. 7 is a rear view of the electrical connector shown in FIG. 6 with a portion of a housing of the electrical connector removed.

FIG. 7 is a rear view of the electrical connector 200 with the cap portion 228 (shown in FIG. 6) of the housing 204 removed. FIG. 7 illustrates a circuit board 232 and a plurality of mating contacts 234 coupled to the circuit board 232. The mating contacts 234 are represented in FIG. 7 as insulation displacement contacts (IDC's) that are configured for connection to individual wires 236 (only two are illustrated in FIG. 7) of the cable 202. For example, the wires 236 are twisted wire pairs that define differential signal pairs. The wires 236 are loaded into openings of the mating contacts 234 to electrically connect the wires 236 with the mating contacts 234. The mating contacts 234 may be coupled to the circuit board 232 by a known mounting method, such as by loading the mating contacts 234 into vias in the circuit board 232 or by soldering or surface mounting the mating contacts 234 to the circuit board 232. The contacts 208 (shown in FIG. 6) are also electrically connected to the circuit board 232 such that the contacts 208 are electrically connected to respective ones of the mating contacts 234 by the circuit board 232.

Optionally, the cap portion 228 may be used to couple the wires 236 to the mating contacts 234. For example, the wires 236 may be loaded into individual wire holding slots in a rear end of the cap portion 228. When the cap portion 228 is coupled to the main housing portion 230, the wires 236 may be terminated to the mating contacts 234.

Figure 8:
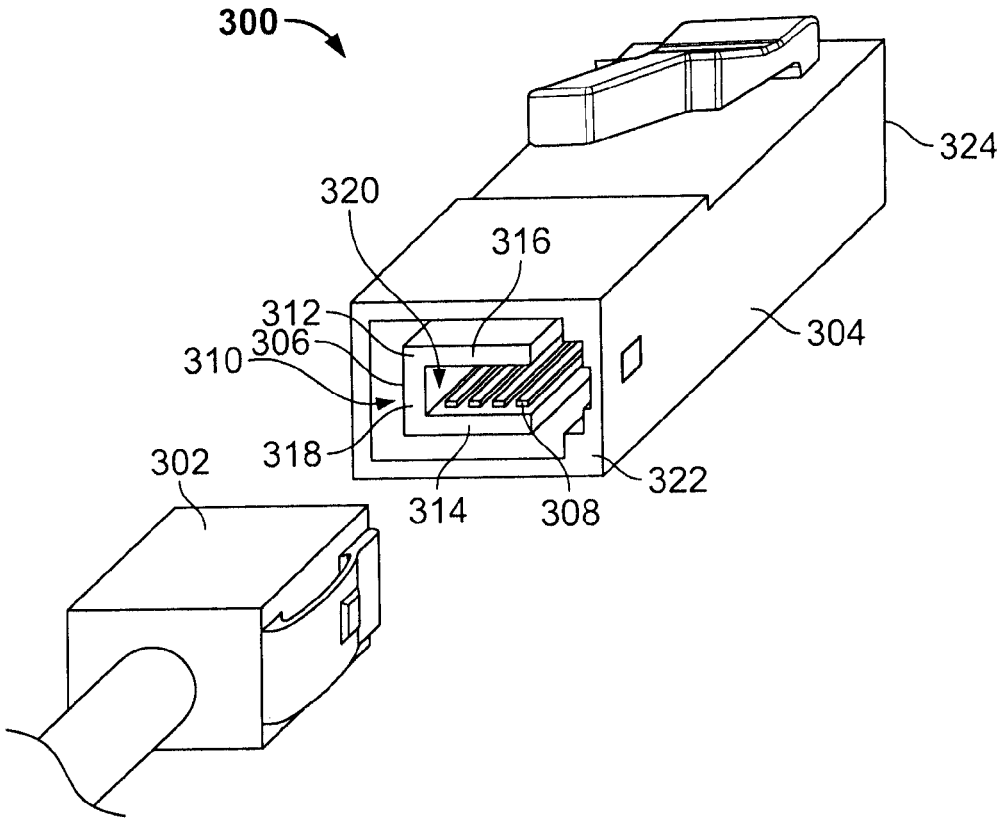
FIG. 8 is a front perspective view of yet another electrical connector formed in accordance with a further alternative embodiment.
Figure 9:
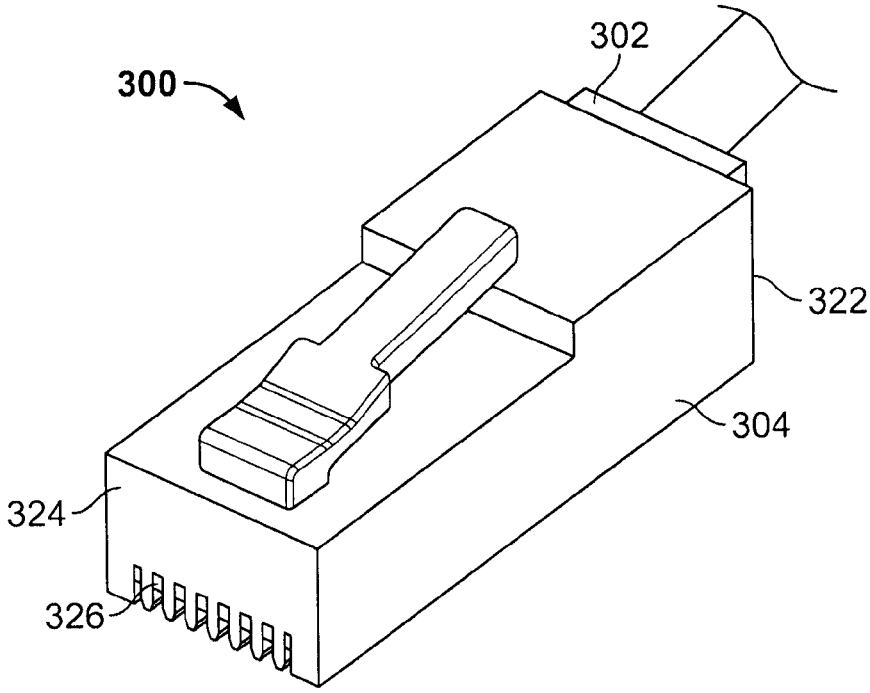
FIG. 9 is a rear perspective view of the electrical connector shown in FIG. 8.

FIGS. 8 and 9 are front and rear perspective views of yet another electrical connector 300 formed in accordance with a further alternative embodiment. A mating connector 302 may be coupled to the electrical connector 300. The electrical connector 300 includes a housing 304 and a contact sub-assembly 306 having a plurality of first mating contacts 308 for mating with the mating connector 302. The electrical connector 300 represents a receptacle connector having a cavity 310 that receives the mating connector.

The contact sub-assembly 306 includes a mating portion 312 having opposed support walls 314, 316 and a single end wall 318 extending between one of the ends of the support walls 314, 316. The mating portion 312 defines a gap 320 between the support walls 314, 316 and the gap 320 opens to the cavity 310. The gap 320 defines a space sized and shaped to accept a portion of the mating connector therein. The first mating contacts 308 extend along the support walls 314, 316 such that the first mating contacts 308 face, and are exposed to, the gap 320.

The housing 304 extends between a first mating end 322 and a second mating end 324. The electrical connector 300 defines a receptacle connector at the first mating end 322 for connection with a plug-type mating connector 302. The first mating end 322 and the mating connector 302 have a mating interface defined for use within a first wiring system, wherein plugs and receptacles within the first wiring system have a mating interface similar to that shown in FIGS. 8 and 9. As shown in FIG. 9, the electrical connector 300 defines a plug type connector at the second mating end 324 for mating with a corresponding receptacle type of connector (not shown). The second mating end 324 and the corresponding connector have a mating interface defined for use within a second wiring system, wherein plugs and receptacles within the second wiring system have a mating interface similar to that shown in FIGS. 8 and 9. The mating interface defined at the second mating end 324 is different than the mating interface of the mating connector 302, such that the second mating end 324 could not be plugged into a receptacle connector having a mating interface of the type at the first mating end 322. The electrical connector 300 may be used as an adaptor for interconnecting components or cables from the first wiring system with components or cables from the second wiring system.

In an exemplary embodiment, the second mating end 324 represents an 8P8C modular connector, such as an RJ-45 plug or other type of connector used within a network cabling system. The second mating end 324 includes second mating contacts 326. In the illustrated embodiment, eight second mating contacts 326 are provided and the second mating contacts 326 are arranged in a single row.

In an exemplary embodiment, the first mating contacts 308 are electrically connected with the second mating contacts 326, which are both arranged as differential signal pairs of contacts. Optionally, both the first and second contacts 308, 326 are interconnected by a circuit board (not shown) that is received within the housing 304. Additionally, the circuit board may provide electrical compensation for controlling the electrical characteristics of the signal pairs. For example, the electrical characteristics may be matched to particular standards that govern the first and second wiring system.

In an alternative embodiment, rather than terminating to a circuit board, the first mating contacts 308 may be integrally formed with corresponding ones of the second mating contacts 326. Compensation may be provided by controlling the positions of the contacts with respect to one another between the first and second mating ends 322, 324.

Figure 10:
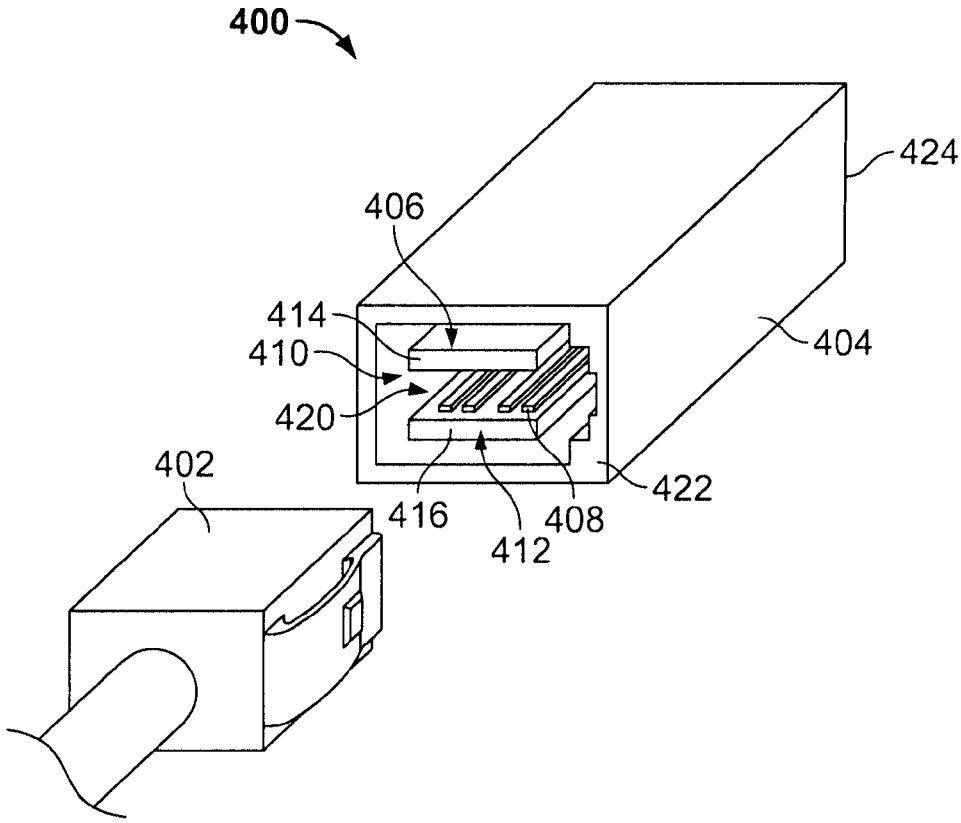
FIG. 10 is a front perspective view of another electrical connector formed in accordance with another alternative embodiment.
Figure 11:
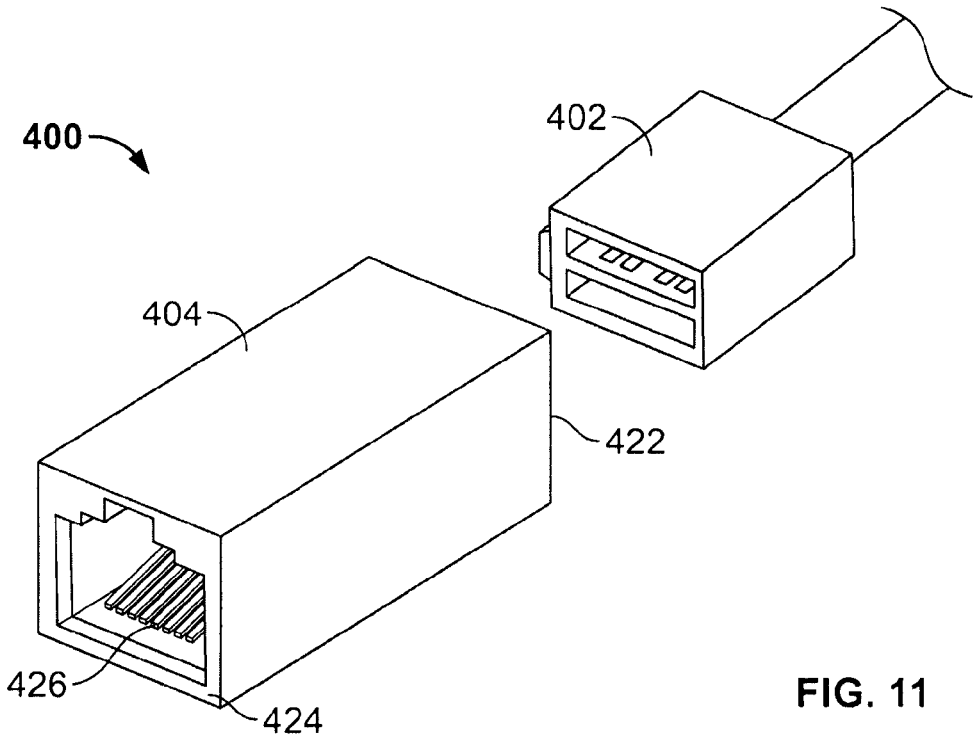
FIG. 11 is a rear perspective view of the electrical connector shown in FIG. 10.

FIGS. 10 and 11 are front and rear perspective views of another electrical connector 400 formed in accordance with another alternative embodiment. A mating connector 402 may be coupled to the electrical connector 400. The electrical connector 400 includes a housing 404 and a contact sub-assembly 406 having a plurality of first mating contacts 408 for mating with the mating connector 402. The electrical connector 400 represents a receptacle connector having a cavity 410 that receives the mating connector.

The contact sub-assembly 406 includes a mating portion 412 having opposed support walls 414, 416. The mating portion 412 defines a gap 420 between the support walls 414, 416 and the gap 420 opens to the cavity 410 at both ends of the support walls 414, 416. The gap 420 defines a space sized and shaped to accept a portion of the mating connector therein. The first mating contacts 408 extend along the support walls 414, 416 such that the first mating contacts 408 face, and are exposed to, the gap 420.

The housing 404 extends between a first mating end 422 and a second mating end 424. The electrical connector 400 defines a receptacle connector at the first mating end 422 for connection with a plug-type mating connector 402. The first mating end 422 and the mating connector 402 have a mating interface defined for use within a first wiring system, wherein plugs and receptacles within the first wiring system have a mating interface similar to that shown in FIGS. 10 and 11. As shown in FIG. 11, the electrical connector 400 also defines a receptacle type connector at the second mating end 424 for mating with a corresponding plug type of connector (not shown). The second mating end 424 and the corresponding connector have a mating interface defined for use within a second wiring system, wherein plugs and receptacles within the second wiring system have a mating interface similar to that shown in FIGS. 10 and 11. The mating interface defined at the second mating end 424 is different than the mating interface of the mating connector 402, such that the plug for the second mating end 424 could not be plugged into the first mating end 422. The electrical connector 400 may be used as an adapter for interconnecting components or cables from the first wiring system with components or cables from the second wiring system.

In an exemplary embodiment, the second mating end 424 represents an 8P8C modular connector, such as an RJ-45 jack or other type of connector used within a network cabling system. The second mating end 424 includes second mating contacts 426. In the illustrated embodiment, eight second mating contacts 426 are provided and the second mating contacts 426 are arranged in a single row.

In an exemplary embodiment, the first mating contacts 408 are electrically connected with the second mating contacts 426, which are both arranged as differential signal pairs of contacts. Optionally, both the first and second contacts 408, 426 are interconnected by a circuit board (not shown) that is received within the housing 404. Additionally, the circuit board may provide electrical compensation for controlling the electrical characteristics of the signal pairs. For example, the electrical characteristics may be matched to particular standards that govern the first and second wiring system.

In an alternative embodiment, rather than terminating to a circuit board, the first mating contacts 408 may be integrally formed with corresponding ones of the second mating contacts 426. Compensation may be provided by controlling the positions of the contacts with respect to one another between the first and second mating ends 422, 424.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. § 112, sixth paragraph, unless and until such claim limitations expressly use the phrase "means for" followed by a statement of function void of further structure.

What is claimed is:

1. An electrical connector comprising:

a contact sub-assembly having a plurality of contacts arranged on a contact support member, the contacts have a mating end and a termination end with the mating end being configured to engage the mating connector and with the termination end being configured to be terminated to one of a circuit board and a wire, the contact support member having a pair of opposed support walls extending from a base end to a mating end, the support walls being separated by a gap that extends from the mating end toward the base end, the contacts extend at least partially along the support walls between the mating end and the base end, wherein a first set of the contacts are provided on one of the support walls and a second set of the contacts are provided on the other of the support walls, the contacts arc exposed to the gap for connection with the mating connector received within the gap; and a housing having a cavity, wherein the contact sub-assembly is received within the cavity such that a gap is created between the contact sub-assembly and the housing, the housing is configured to receive the mating connector within the gap such that a perimeter of the contact support member is surrounded by the mating connector at least along a portion of a length of the support walls.

2. The connector of claim 1, wherein the cavity concentrically surrounds the support walls from the base ends to the mating ends.

3. The connector of claim 1, wherein the electrical connector is configured to be co-nested with the mating connector, wherein the housing surrounds a perimeter of the mating connector and the mating connector surrounds a perimeter of the contact support member along a mating axis.

4. The connector of claim 1, wherein the contact support member completely encloses the gap separating the support walls.

5. The connector of claim 1, wherein is coupled to a circuit board, the contacts being terminated to the circuit board such that the first set of contacts are terminated to a first side of the circuit board and the second set of contacts are terminated to a second side of the circuit board.

6. The connector of claim 1, wherein the contact sub-assembly is further configured to be terminated to one of a circuit board and a second mating connector.

7. The connector of claim 1, wherein the contacts are arranged as differential pairs, a first differential pair and a second differential pair are arranged on a first of the support walls and a third differential pair and a fourth differential pair are arranged on a second of the support walls.

8. The connector of claim 1, wherein the contacts are arranged as differential pairs, at least one of the differential pairs include a cross-over section for controlling an electrical interaction with an adjacent one of the differential pairs.

9. The connector of claim 1, wherein the contact support member includes at least one end wall extending between the support walls from the base ends to the mating ends.

10. The connector of claim 1, wherein the housing has inner walls defining the cavity, each support wall being spaced apart from the inner walls of the housing.

11. An electrical connector comprising:

a housing and a plurality of contact sub-assemblies coupled to the housing;

wherein the housing includes a mating end and a terminating end, the housing has a plurality of cavities that receive respective ones of the contact sub-assemblies therein, and the cavities arc configured to receive mating connectors through the mating end of the housing for interconnection with the contact sub-assemblies; and wherein each contact sub-assembly includes a base, a contact support member and a plurality of contacts, the base is coupled to the terminating end of the housing and is configured for mounting to a mating component, the contact support member extends from the base and has a pair of opposed, axially extending, support walls that are separated by a gap, each support wall includes an inner surface facing the gap, the contacts are arranged on the inner surfaces of respective ones of the support walls.

12. The connector of claim 11, wherein the base comprises a circuit board, the contacts are terminated to the circuit board.

13. The connector of claim 11, wherein the contact sub-assembly further includes a header assembly coupled to the base, the header assembly is configured to be mounted to the mating component.

14. The connector of claim 11, wherein the mating component is one of a circuit board and a cable, wherein the base includes mounting contacts configured to electrically and mechanically connect to one of the circuit board and the cable.

15. The connector of claim 11, wherein the cavities are arranged in at least one of a common row and a common column.

16. The connector of claim 11, wherein the housing includes a dielectric body defining the cavities and a cover surrounding a majority of the body and defining an electromagnetic interference shield.

17. The connector of claim II, wherein the cavities are arranged in a stacked configuration, and wherein the bases of at least two contact sub-assemblies define a common base represented by a circuit board configured to be mounted to the mating component, the contact support members of the contact sub-assemblies are each coupled to the circuit board.

18. An electrical connector comprising:

a housing having a first mating end and a second mating end, the first mating end having a cavity configured to receive a first mating connector, the second mating end having mating contacts for engaging a second mating connector; and a contact sub-assembly at least partially received within the cavity for mating with the first mating connector, the contact sub-assembly includes a base, a contact support member and a plurality of contacts, the contact support member extends from the base and is at least partially received within the cavity, the contact support member has a pair of opposed, axially extending, support walls that are separated by a gap, each support wall includes an inner surface facing the gap, wherein the contacts are arranged on the inner surfaces of respective ones of the support walls for engagement with the first mating connector, and wherein the contacts are terminated to the base and electrically connected to the mating contacts at the second mating end of the housing by the base;

wherein the housing and contact sub-assembly define an adapter having a first mating interface at the first mating end configured to mate with the first mating connector of a wiring system of a first type, and the adapter has a second mating interface at the second mating end configured to mate with the second mating connector of a wiring system of a second type, different from the first type of wiring system.

19. The connector of claim 18, wherein the contacts of the contact sub- assembly are arranged in a first pattern having substantially parallel contact axes arranged in two different parallel planes, and wherein the mating contacts at the second mating end have a different pattern from the first pattern.

20. The connector of claim 18, wherein the second mating interface defines one of a modular plug and a modular jack having the mating contacts arranged in a single row.

* * * * *